US007456564B2

(12) United States Patent
Song et al.

(10) Patent No.: US 7,456,564 B2
(45) Date of Patent: Nov. 25, 2008

(54) FIELD EMISSION DISPLAY HAVING A GATE PORTION WITH A METAL MESH

(75) Inventors: Yoon Ho Song, Daejeon (KR); Jin Ho Lee, Daejeon (KR); Chi Sun Hwang, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 437 days.

(21) Appl. No.: 11/120,679

(22) Filed: May 3, 2005

(65) Prior Publication Data

US 2005/0248256 A1 Nov. 10, 2005

(30) Foreign Application Priority Data

May 4, 2004 (KR) ..... 10-2004-0031508

(51) Int. Cl.
*H01J 1/62* (2006.01)

(52) U.S. Cl. ..... 313/497; 313/294; 313/296

(58) Field of Classification Search ..... 313/495–497, 313/294, 295, 296
See application file for complete search history.

(56) References Cited

U.S. PATENT DOCUMENTS

| | | | | |
|---|---|---|---|---|
| 5,015,912 | A * | 5/1991 | Spindt et al. | 313/495 |
| 5,402,041 | A * | 3/1995 | Kishino et al. | 313/336 |
| 5,616,991 | A | 4/1997 | Casper et al. | |
| 7,045,947 | B2 * | 5/2006 | Van Der Vaart et al. | 313/495 |
| 2002/0053867 | A1 * | 5/2002 | Van Der Vaart et al. | 313/446 |
| 2002/0080099 | A1 * | 6/2002 | Song et al. | 345/75.2 |
| 2004/0256976 | A1 * | 12/2004 | Van Der Vaart et al. | 313/495 |

(Continued)

FOREIGN PATENT DOCUMENTS

| | | |
|---|---|---|
| JP | 03-295138 | 12/1991 |

(Continued)

OTHER PUBLICATIONS

'Ultrastable emission from a metal-oxide-semiconductor field-effect transistor-structured Si emitter tip' Junji Itoh et al., Appl. Phys. Lett. 69 (11), Sep. 9, 1996, American Institute of Physics, pp. 1577-1578.

(Continued)

*Primary Examiner*—Peter Macchiarolo
(74) *Attorney, Agent, or Firm*—Ladas & Parry LLP

(57) ABSTRACT

Provided is a field emission display, which includes: a cathode portion including row signal lines and column signal lines in a stripe form allowing matrix addressing to be carried out on a substrate, and pixels defined by the row signal lines and the column signal lines, each pixel having a field emitter and a control device which controls the field emitter with two terminals connected to at least the row signal line and the column signal line and one terminal connected to the field emitter; an anode portion having an anode electrode, and a phosphor connected to the anode electrode; and a gate portion having a metal mesh with a plurality of penetrating holes, and a dielectric layer formed on at least one region of the metal mesh, wherein the gate portion is disposed between the cathode portion and the anode portion to allow the surface where the dielectric layer is formed to be faced to the cathode portion and to allow electrons emitted from the field emitter to collide with the phosphor via the penetrating holes.

14 Claims, 8 Drawing Sheets

U.S. PATENT DOCUMENTS

2005/0083267 A1* 4/2005 Yotani et al. ..... 345/75.2

FOREIGN PATENT DOCUMENTS

| | | |
|---|---|---|
| JP | 4 167326 | 6/1992 |
| JP | 08-031305 | 2/1996 |
| JP | 08-148080 | 6/1996 |
| JP | 07-130306 | 5/1998 |
| JP | 2000-138025 | 5/2000 |
| JP | 2001-035347 | 2/2001 |
| JP | 2001-076652 | 3/2001 |
| JP | 2001-084927 | 3/2001 |
| JP | 2001-101987 | 4/2001 |
| JP | 2001-222967 | 8/2001 |
| JP | 2003-016913 | 1/2003 |
| JP | 2003-308797 | 10/2003 |
| KR | 2001 0037212 | 5/2001 |
| WO | WO 03/041039 | 5/2003 |

OTHER PUBLICATIONS

'Fully sealed, high-brightness carbon-nanotube field-emission display'W.B. Choi et al., Appl. Phys. Lett 75 (20), Nov. 15, 1999, American Institute of Physics, pp. 3129-3131.

W.B. Choi, et al.; "A 4.5-in. Fully Sealed Carbon Nanotube-Based Field-Emission Flat-Panel Display;" SID '99 Digest, pp. 1134-1137 1999.5.

S. Kanemaru, et al.; "MOSFET-structured Si field emitter tip;" 9th IVMC Proc. pp. 34, 1997.

Text of The First Office Action issued by the Chinese Patent Office dated Mar. 28, 2008 for Chinese Patent Appln. No. 200510081766.8.

* cited by examiner

FIELD EMISSION DISPLAY HAVING A GATE PORTION WITH A METAL MESH

CROSS-REFERENCE TO RELATED APPLICATION

This application claims priority to and the benefit of Korean Patent Application No. 2004-0031508, filed May 4, 2004, the disclosure of which is incorporated herein by reference in its entirety.

BACKGROUND

1. Field of the Invention

The present invention relates to a field emission display (FED), and more particularly, to a field emission display comprising a gate portion, a cathode portion, and an anode portion, in which the gate portion is provided with a metal mesh and a dielectric layer formed on at least one region of the metal mesh.

2. Discussion of Related Art

The FED comprises a cathode portion having a field emitter and an anode portion having a phosphor, which are opposite to and spaced apart from each other by a predetermined interval (e.g. 2 mm) and packaged in vacuum. In the FED, electrons are emitted from the field emitter of the cathode and collide with the phosphor of the anode, thereby displaying an image using the cathodoluminescence of the phosphor. Recently, the FED has been widely researched and developed as an alternative to a cathode ray tube (CRT). Here, the electron emission efficiency of the field emitter is significantly dependent on a device structure, an emitter material, and an emitter shape.

Currently, a field emission device can be largely classified into a diode type device comprising a cathode and an anode, and a triode type device comprising a cathode, a gate, and an anode. In general, the diode type field emission device is formed of diamond or carbon nanotube in a film shape. As compared with the triode type field emission device, the diode type field emission device has advantages that its manufacturing process is simple and the reliability of electron emission is good, however, has disadvantages in terms of electron emission control and driving voltage of field emission.

Hereinafter, the conventional FED will be described with reference to accompanying drawings. FIG. 1 is a schematic view illustrating a configuration of an FED having a diode type field emission device.

The conventional FED comprises a cathode portion that has cathode electrodes 11 arranged as a stripe shape on a bottom glass substrate 10B, and film type field emitter materials 12 provided on some regions of the cathode electrodes 11; an anode portion that has transparent anode electrodes 13 arranged as a stripe shape on a top glass substrate 10T, and phosphors 14 of red (R), green (G), and blue (B) colors provided on some regions of the transparent anode electrodes 13; and a spacer 15 to support the cathode portion and the anode portion to be opposite to and parallel with each other when they are packaged in vacuum. Here, the cathode electrodes 11 of the cathode portion and the anode electrodes 13 of the anode portion are aligned to cross each other so that one pixel is defined by each intersection therebetween.

An electric field required for electron emission in the FED of FIG. 1 is given by a voltage difference between the cathode electrode 11 and the anode electrode 13, and it is known that the electron emission typically occurs at the field emitter when an electric field of 0.1V/μm or more is applied to the field emitter material.

The FED of FIG. 2 is proposed to improve the drawback of the FED of FIG. 1, in which FIG. 2 schematically illustrates the configuration of the conventional FED employing a control device for controlling the field emitter corresponding to each pixel.

Referring to FIG. 2, the FED comprises a cathod portion that is provided on a glass substrate 20B and has scan signal lines 21S and data signal lines 21D formed of metal and arranged as a stripe form allowing electrical addressing to be carried out in a matrix, film type (e.g. thin film or thick film) field emitters 22 formed of diamond, diamond-like carbon, carbon nanotube or the like, which are provided in respective pixels defined by the scan signal lines 21S and the data signal lines 21D, and control devices 23 connected to the scan signal lines 21S, the data signal lines 21D and the field emitters 22 and for controlling field emission currents based on a scan signal and a data signal; and an anode portion that is provided on a glass substrate 20T and has transparent anode electrodes 24 arranged in a stripe form, and phosphors 25 of R, G, and B on some portions of the transparent electrodes 24; and a spacer 26 to support the cathode portion and the anode portion to be opposite to and parallel with each other when they are packaged in vacuum.

In the FED of FIG. 2, a high voltage is applied to the anode electrodes 24 to induce an electron emission from the film type field emitter 22 in the cathode portion, and to accelerate the emitted electrons with high energy. At the same time, if a signal of the display is inputted to the control devices 23 through the scan signal line 21S and the data signal line 21D, the control device 23 controls the amount of electrons emitted from the film type field emitter to represent row/column images.

The above-described diode type field emission device employed in the FED of FIGS. 1 and 2 does not require a gate and a gate insulating layer unlike the conical triode type field emission device, so that its structure is simple and easy to be manufactured.

In addition, the diode type field emission device has an extremely low probability in the breakdown of the field emitter resulted from the sputtering effect upon electron emission, so that it not only has high reliability of the device but also prevents the breakdown phenomenon of the gate and the gate insulating layer which is severely problematic in the triode type field emission device.

In accordance with the active matrix FED having the conventional diode type field emission device of FIG. 2, the control device 23 of the field emitter is employed in each pixel and a display signal is input via the control device, so that problems of high drive voltage of FIG. 1 along with non-uniformity of electron emission, cross talk or the like may be solved.

However, the FED which has employed the above-described field emission device has the following drawbacks.

In the FED having the diode type field emission device of FIG. 1, a high electric field required for the field emission (typically several V/um) is applied between the electrodes (cathode electrodes 11 and transparent anode electrodes 13 of FIG. 1) of both of the top and bottom substrates spaced apart from each other by a relatively long interval (typically ranged from 200 μm to 2 mm), so that a display signal should have a high voltage, which in turn causes an expensive drive circuit of high voltage to be required. In particular, although the voltage necessary for the field emission is decreased by reducing the interval between the top and bottom substrates in the FED having the diode type field emission device of FIG. 1, the anode electrode 13 is used as both a wiring line for the display signal and the electrode for accelerating electrons, so that it is impossible to implement the low voltage drive.

In the FED, a high energy of 200 eV or more are typically required to make the phosphor to emit light, and the luminous efficiency becomes higher as the electron energy increases, so that the high brightness FED can be achieved only when a high voltage is applied to the anode electrode. However, the high voltage applied to the anode electrode 24 and used for both the field emission and the electron acceleration induces a relatively high voltage to the control device 23 of each pixel, and is like to cause the breakdown of the control device when a voltage exceeding the breakdown voltage is induced to the control device 23.

Accordingly, the voltage applied to the anode electrode 24 is limited according to the breakdown characteristic of the control device 23, and the limited anode voltage causes a difficulty in manufacturing the FED having high brightness.

SUMMARY OF THE INVENTION

The present invention is directed to an FED capable of reducing a display row/column driving voltage.

The present invention is also directed to an FED configured to apply an electric field required for field emission via a gate electrode to allow an interval between an anode portion and a cathode portion to be freely adjusted so that a high voltage may be applied to the anode electrode and resultant brightness of the FED may be enhanced.

The present invention is also directed to an FED allowing a gate in a metal mesh form to be separately manufactured and assembled with the cathode portion so that its manufacturing process may be facilitated and manufacturing productivity and yield may be enhanced.

The present invention is also directed to an FED capable of implementing a high resolution by allowing electrons emitted from a field emitter to be focused on a phosphor of an anode.

One aspect of the present invention is to provide a field emission display including: a cathode portion including row signal lines and column signal lines in a stripe form allowing matrix addressing to be carried out on a substrate, and pixels defined by the row signal lines and the column signal lines, each pixel having a field emitter and a control device which controls the field emitter with two terminals connected to at least the row signal line and the column signal line and one terminal connected to the field emitter; an anode portion having an anode electrode, and a phosphor connected to the anode electrode; and a gate portion having a metal mesh with a plurality of penetrating holes, and a dielectric layer formed on at least one region of the metal mesh, wherein the gate portion is disposed between the cathode portion and the anode portion to allow the surface where the dielectric layer is formed to be faced to the cathode portion and to allow electrons emitted from the field emitter to collide with the phosphor via the penetrating holes.

The dielectric layer may be formed on an entire surface or a portion of the surface of the metal mesh, and each of the penetrating holes of the metal mesh may have at least one inclined inner wall.

The dielectric layer may be configured to cover the inclined inner wall of the penetrating hole, and the inner wall of the metal mesh may be configured to include at least two inclined angles so that it may have a protrusion.

BRIEF DESCRIPTION OF THE DRAWINGS

The above and other features and advantages of the present invention will become more apparent to those of ordinary skill in the art by describing in detail preferred embodiments thereof with reference to the attached drawings in which.

DETAILED DESCRIPTION OF PREFERRED EMBODIMENTS

The present invention will now be described more fully hereinafter with reference to the accompanying drawings, in which preferred embodiments of the invention are shown. This invention may, however, be embodied in different forms and should not be construed as limited to the embodiments set forth herein. Rather, these embodiments are provided so that this disclosure is thorough and complete and fully conveys the scope of the invention to those skilled in the art.

Figure 1:
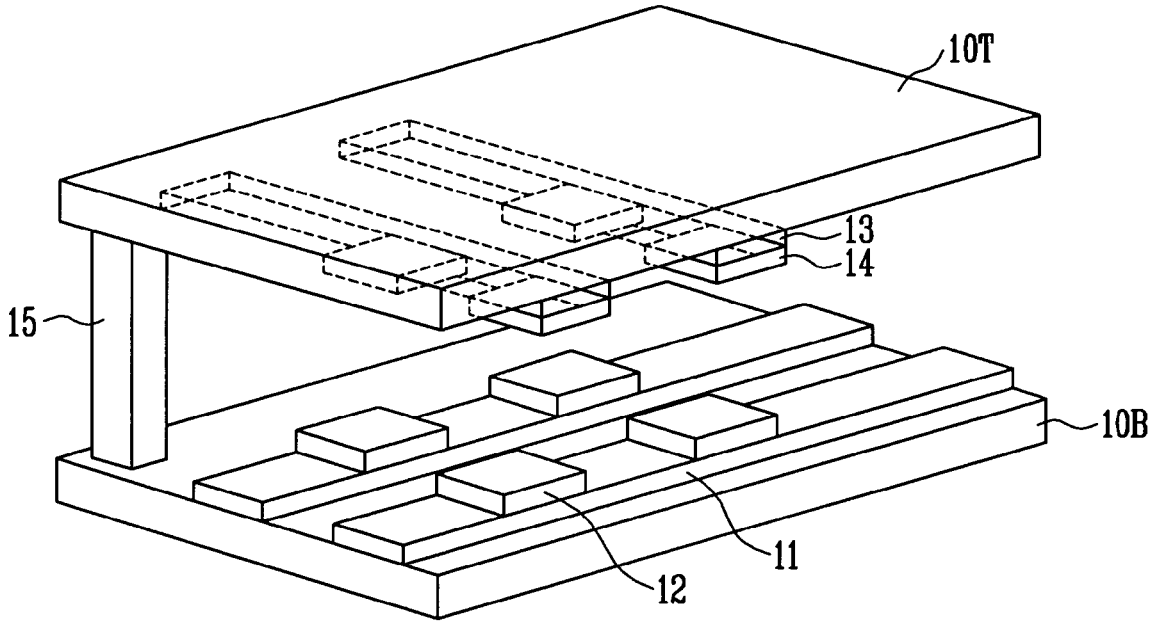
FIG. 1 (PRIOR ART)
FIG. 1 is a schematic view illustrating a configuration of an FED having a conventional diode type field emission device.
Figure 2:
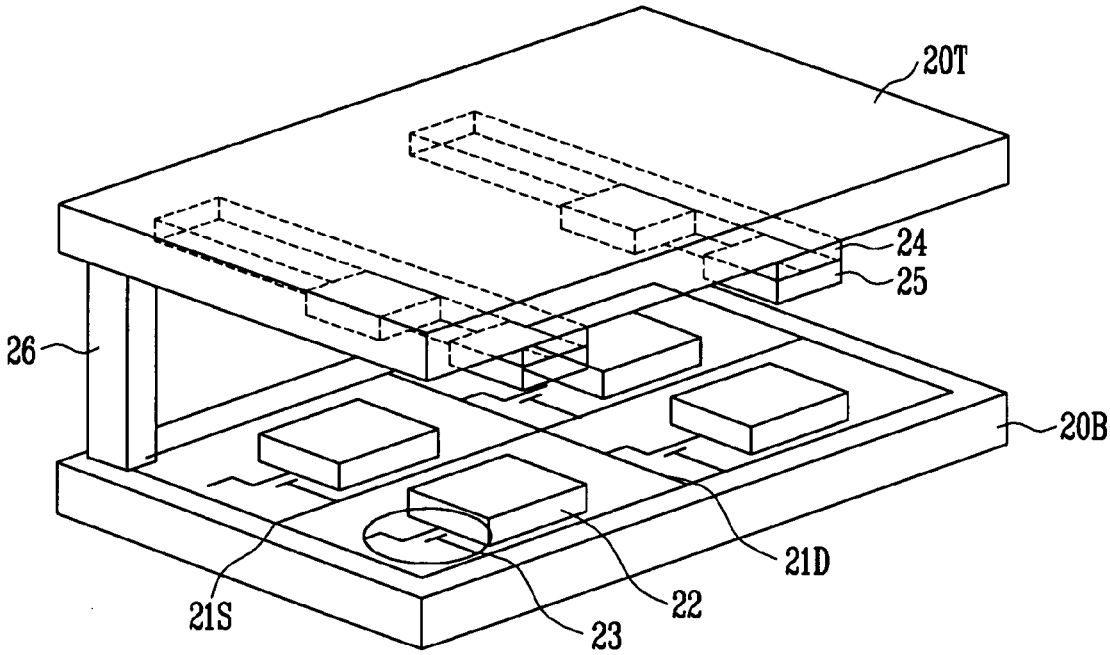
FIG. 2 (PRIOR ART)
FIG. 2 is a schematic view illustrating a configuration of an FED having a conventional diode type field emission device and a control device.
Figure 3:
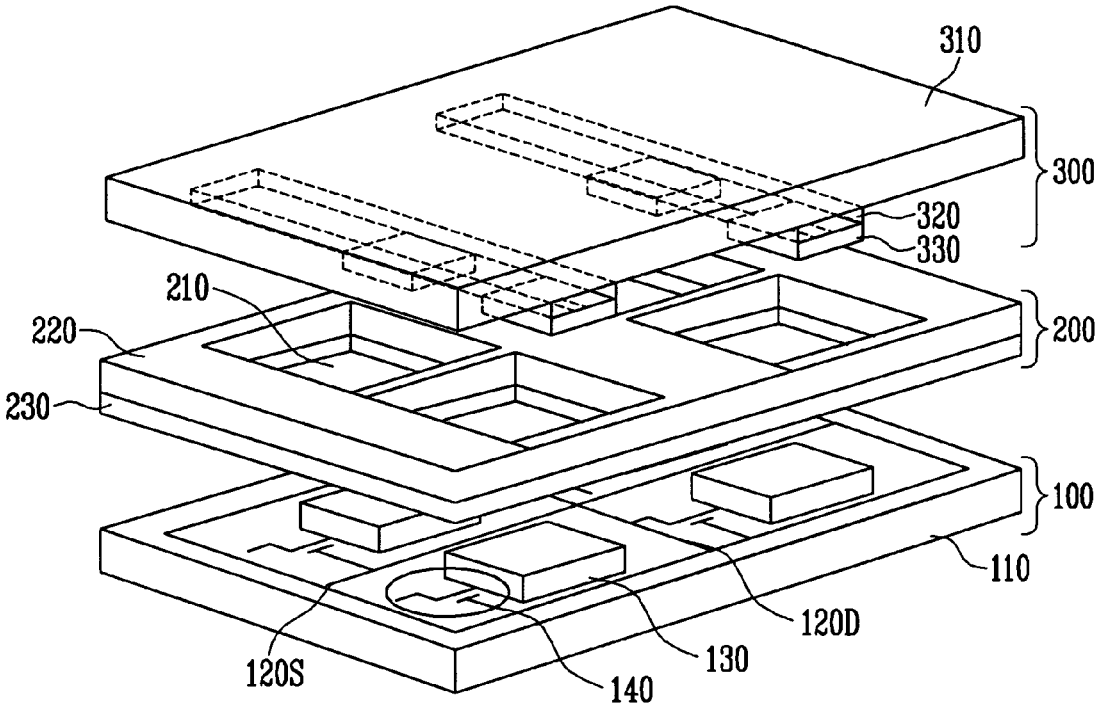
FIG. 3 is a schematic view illustrating a configuration of an FED in accordance with an embodiment of the present invention.
Figure 4:
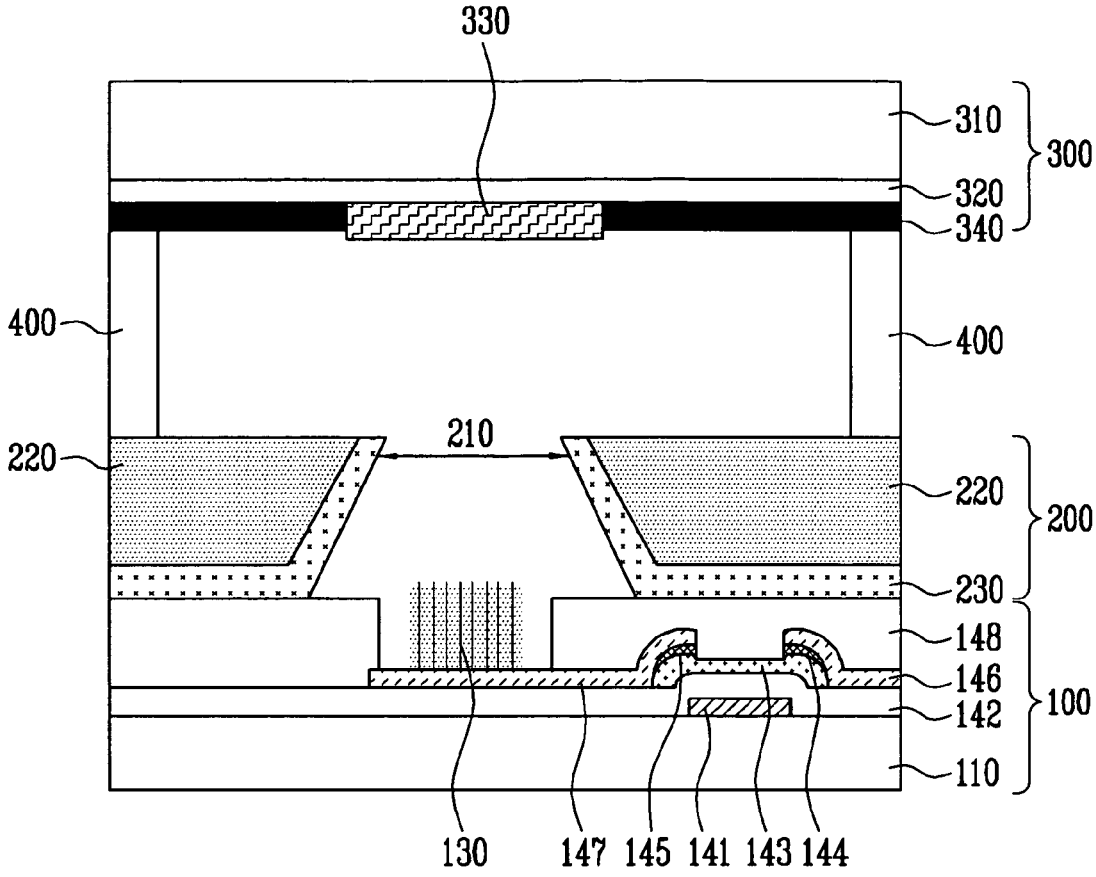
FIG. 4 is a schematic cross-sectional view of the FED of FIG. 3.

FIG. 3 is a schematic view illustrating a configuration of an FED in accordance with an embodiment of the present invention, and FIG. 4 is a schematic cross-sectional view of the FED of FIG. 3.

The FED of FIG. 3 is comprised of a cathode portion 100, a gate portion 200, and an anode portion 300.

The cathode portion 100 has a row signal line 120S and a column signal line 120D in a stripe form which are formed of conductive layers on a substrate 110 such as glass, plastic, various ceramics, various transparent insulating substrates or the like to allow electrical addressing to be carried out in a matrix. Each of unit pixels is defined by the row signal line 120S and the column signal line 120D. Each pixel has a film type (thin film or thick film) field emitter 130 formed of one of diamond, diamond-like carbon, carbon nanotube, carbon nanofiber or the like, and a control device 140 for controlling the field emitter 130. The control device 140 preferably has two terminals connected to at least to the row signal line 120S and the column signal line 120D and one terminal connected to the film type field emitter 130. For example, an amorphous thin film transistor, a polysilicon thin film transistor, a metal-oxide-semiconductor field effect transistor (MOSFET) or the like may be employed as the control device 140.

The gate portion 200 includes a metal mesh 220, a plurality of penetrating holes 210 formed within the metal mesh 220, and a dielectric layer 230 on at least a portion of the surface faced to the cathode portion 100. Preferably, each of the penetrating hole 210 has a structure such that it has an inclined inner wall and a hole size thereof is decreased toward the anode portion 300 from the cathode portion 100. This structure serves to focus electrons emitted from the field emitter 130 on the phosphor 330 of the anode, so that the FED having a high resolution may be manufactured. Meanwhile, it is apparent to those skilled in the art that size, shape or the like of the penetrating hole 210 are not specifically limited, but may be varied.

In addition, the dielectric layer 230 formed on the inner wall of the penetrating hole 210 serves to prevent electrons emitted from the field emitter 130 from directly colliding with the metal mesh 220. Accordingly, the dielectric layer 230 may be formed on the entire surface of the metal mesh 220 or may be formed only on a portion of the surface. Preferably, the dielectric layer 230 may be formed to cover the inclined inner wall of the penetrating hole 210. Meanwhile, when the dielectric layer 230 is formed only on the portion of the metal mesh 220, damages due to a difference of thermal expansion coefficients may be more effectively prevented.

Various kinds including a silicon oxide layer deposited by a typical chemical vapor deposition (CVD) method, a thin film such as silicon nitride layer or the like employed for a typical semiconductor process, a silicon oxide layer formed by spin-coating a Spin-On-Glass (SOG) layer, a thick insulating layer formed by a screen printing method used for a typical plasma display, that is, a paste/sintering method, or the like may be employed as the dielectric layer 230, and the paste/sintering method is preferably employed to form the dielectric layer 230.

The metal mesh 220, which is separate from the cathode portion, may be formed of a single metal plate such as aluminum, iron, copper, nickel or an alloy thereof, and may also be formed of an alloy plate having a low thermal expansion coefficient such as stainless steel, invar, kovar or the like.

Preferably, in consideration of the above-described gate portion 200, the metal mesh 220 may be formed to have a thickness ranged from 10 μm to 500 μm, and the dielectric layer 230 may be formed to have a thickness ranged from 0.1 μm to 500 μm.

The anode portion 300, for example, has anode electrodes 320 of transparent conductive layers, and R, G, and B phosphors 330 each being formed on a portion of the anode electrode 320 on a transparent substrate 310 such as glass, plastic, various ceramics, various transparent insulating substrates, or the like.

Meanwhile, the cathode portion 100, the gate portion 200 and the anode portion 300 are vacuum-packaged such that the field emitter 130 of the cathode portion 100 is opposite to and in parallel with the phosphor 330 of the anode portion 300 via the penetrating hole 210 of the gate portion 200 with a typical spacer (not shown) being held between the gate portion and the anode portion. The spacer (not shown) may be formed of glass bead, ceramic, polymer or the like, and may have a thickness of 200 μm to 3 mm.

The metal mesh 220 of the gate portion of the present FED serves to prevent electrons from being emitted due to the voltage applied to the anode electrode 320, and allows a uniform potential to be formed as a whole between the anode portion 300 and the gate portion 200 to prevent local arcing.

The penetrating hole 210 having the inclined inner wall allows electrons emitted from the field emitter 130 to be focused on the phosphor 330 of the anode portion 300 so that the FED having a high resolution may be manufactured.

Next, an example of a method for manufacturing an FED according to an embodiment of the present invention will be described in detail with reference to FIG. 4. FIG. 4 is a cross-sectional view illustrating a unit pixel taken along a portion of the FED in accordance with the present invention. Referring to FIG. 4, vacuum-packaging is carried out such that a gate portion is close to a cathode portion while an anode portion is spaced apart from the gate portion with a spacer being held therebetween. The cathode portion, the gate portion, and the anode portion may be separately manufactured and then assembled together.

The FED of FIG. 4 includes a cathode portion 100, a gate portion 200, and an anode portion 300. The cathode portion has a substrate 110, a thin film transistor, a field emitter 130, or the like.

The thin film transistor may include a gate 141 formed of metal on a portion of the substrate 110, a gate insulating layer 142 formed of a silicon oxide layer or an amorphous silicon nitride layer (a-SiNx) on the substrate 110 having the gate 141, an active layer 143 formed of amorphous silicon (a-Si) on a portion of the gate insulating layer 142 and the gate 141, source 144 and drain 145 formed of n-type amorphous silicon at both ends of the active layer 143, a source electrode 146 formed of metal on a portion of the gate insulating layer 142 and the source 144, a drain electrode 147 formed of metal on a portion of the gate insulating layer 142 and the drain 145, and an inter-layer insulating layer (passivation insulating layer) 148 formed of an amorphous silicon nitride or silicon oxide layer on a portion of the drain electrode 147 and the source electrode 146 and the active layer 143. The thin film transistor shown in FIG. 4 has a bottom gate structure, however, it is apparent that it may have a top gate structure.

The field emitter 130 is disposed on a portion of the drain electrode 147 of the thin film transistor, and may be formed of one of diamond, diamond-like carbon, carbon nanotube, carbon nanofiber, or the like.

The gate portion 200 has a metal mesh 220 with a penetrating hole 210, and a dielectric layer 230, wherein the penetrating hole 210 allows electrons emitted from the field emitter 130 of the cathode portion 100 to be penetrated and the gate portion 200 and the anode portion 300 are supported by a spacer 400 to each other when seen in a plan view. A phosphor 330 of the anode portion 300 and the field emitter 130 of the cathode portion 100 are vacuum-packaged such that they are aligned to be opposite to each other.

The penetrating hole 210 of the gate portion 200 has an inclined inner wall, and the inclined angle is not specifically limited but may be varied when it can serve to allow electrons emitted from the field emitter to be focused on the phosphor 330 of the anode portion 300. In addition, the dielectric layer 230 has a structure for covering the inclined inner wall. The spacer 400 serves to keep an interval between the cathode portion 100 and the anode portion 300, which is not necessarily disposed to all pixels.

The anode portion 300 has an anode electrode 320 formed on a portion of the substrate 310, R, G, and B phosphors 330 connected to the anode electrode 320, and a black matrix 340 formed between the phosphors 330. The anode electrode 320 is preferably a transparent electrode formed of a transparent conductive material or a thin metal layer.

Meanwhile, the gate portion 200 may be independently manufactured from the cathode portion 100 so that its manufacturing process is very simple, and the gate portion 100, the cathode portion 200, and the anode portion 300 which are separately manufactured may be assembled together, so that manufacturing productivity and yield may be enhanced.

Next, a driving principle of the FED according to the present embodiment will be described in detail with reference to FIG. 4.

A direct current (DC) voltage, for example, 50 to 500V is applied to the metal mesh 220 of the gate portion 200 to induce electron emission from the field emitter 130 of the cathode portion 100 while a high voltage of about 1 to 10 kV is applied to the anode electrode 320 of the anode portion 300 to accelerate the emitted electrons with high energy. Meanwhile, a voltage applied to a row signal line 120S and a column signal line 120D of the FED is adjusted to control the operation of the control device disposed at each pixel of the cathode portion 100. That is, the control device (140 of FIG. 3) of each pixel controls electron emission of the field emitter 130 to realize images.

In this case, a voltage applied to the metal mesh 220 of the gate portion 200 acts to suppress electron emission of the field emitter 130 due to the anode voltage, and also acts to prevent local arcing by forming a uniform potential as a whole between the anode portion 300 and the gate portion 200. A voltage applied to the row signal line 120S and the column signal line 120D of the FED is connected to the respective gate and source of the control device, and the voltage applied to the gate may be in a range of 10V to 50V when a thin film transistor having an active layer formed of amorphous silicon is turned on, and may be negative when it is turned off. In addition, the voltage applied to the source may be in a range of 0V to 50V. Such control for the applied voltage is carried out by an external driver circuit (not shown).

Next, gray scale representation of the present FED will be described.

The gray scale representation of the typical diode type field emission device is carried out using a pulse width modulation (PWM) technique. Such a technique adjusts the on-time duration of the voltage of the data signal applied to the field emitter to represent the gray scale, which is realized through a difference of the amount of electrons emitted as the on-time duration. That is, the corresponding pixel emits light having higher brightness when the amount of electrons is large for a given time. However, such a technique is accompanied by a severe limitation while the pulse width (time) allocated to the unit pixel is gradually reduced for implementing a large sized screen. In addition, it is difficult to accurately control the amount of emitted electrons.

The driving technique of the embodiment solves the above-described problem, and the gray scale representation of the FED may be carried out independently using PWM or pulse amplitude (PAM) or using a combination thereof. The PAM technique adjusts the amplitude applied to the data signal to represent the gray scale, which uses the fact that the amount of electrons from the field emitter may be changed due to a difference of the voltage level applied to the source when the thin film transistor is turned on. The number of the difference of the voltage level may also be changed to two or more to represent the gray scale. The driving technique may be applied to the large-sized screen and allows the electron emission to be constantly controlled.

Figure 5:
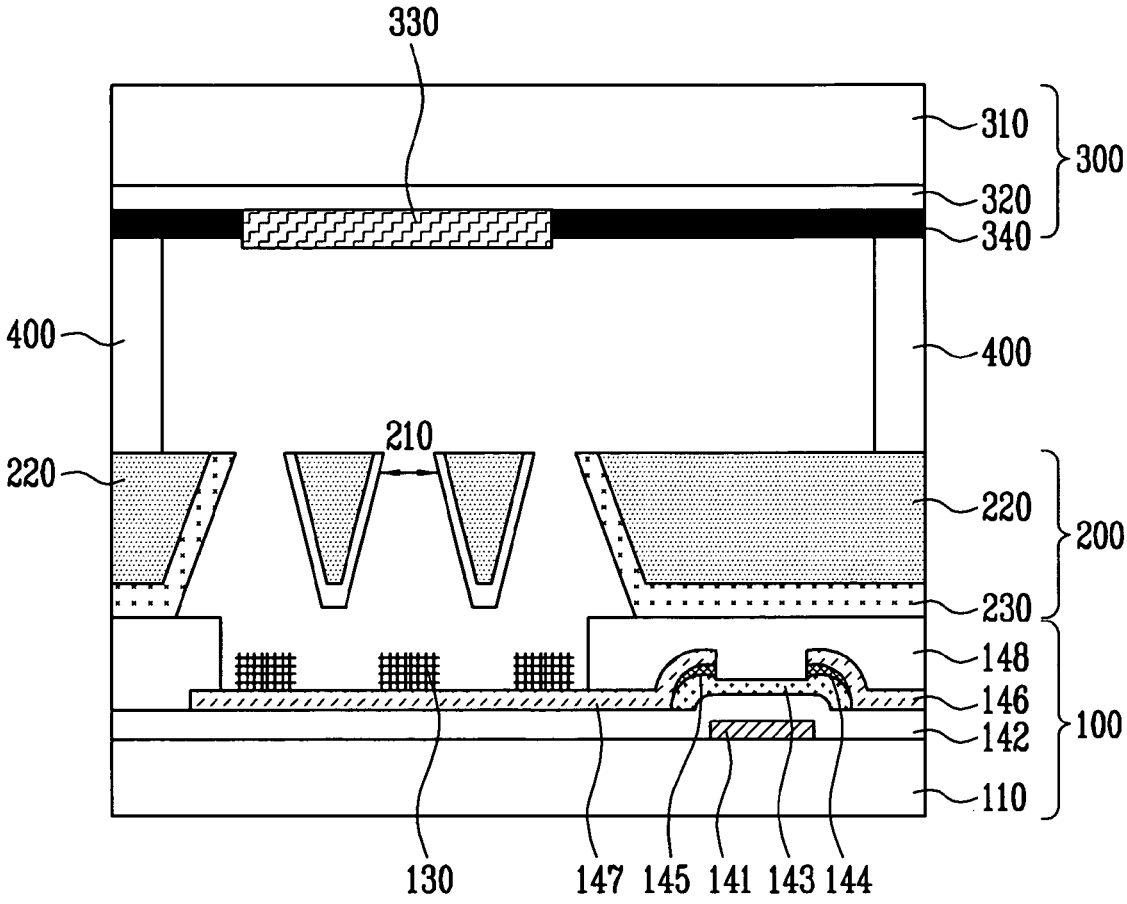
FIG. 5 is a cross-sectional view of a unit pixel taken along some portion of an FED in accordance with another embodiment of the present invention.

Hereinafter, another embodiment or modified embodiments of the present invention will be described in detail with reference to FIG. 5. However, a portion different from the above-described embodiment will be described for simplicity of description. FIG. 5 is a cross-sectional view illustrating a unit pixel taken along a portion of the FED in accordance with another embodiment of the present invention.

Another embodiment of the present invention differs from the FED of FIG. 4 in that a plurality of penetrating holes 210 of the gate portion 200 is formed per unit pixel. In this case, the dot number of the field emitter 130 of the cathode portion 100 may be equal to that of the penetrating hole 210, or the number of the field emitter 130 may also be one. Referring to FIG. 5, the dot number of the field emitter 130 is shown to be equal to that of the penetrating hole 210. That is, it is shown that electrons focused on each unit pixel of phosphors 330 of R, G, and B penetrate several penetrating holes 210. Such a structure has an advantage allowing a high voltage to be effectively applied to the anode electrode 320, which may prevent an electric field with the high anode voltage from adversely affecting the field emitter 130 by the several dots.

At least one of the penetrating holes 210 of the gate portion 200 has an inclined inner wall. FIG. 5 shows that every penetrating hole 210 has the inclined inner wall, however not necessarily limited thereto.

Figure 6:
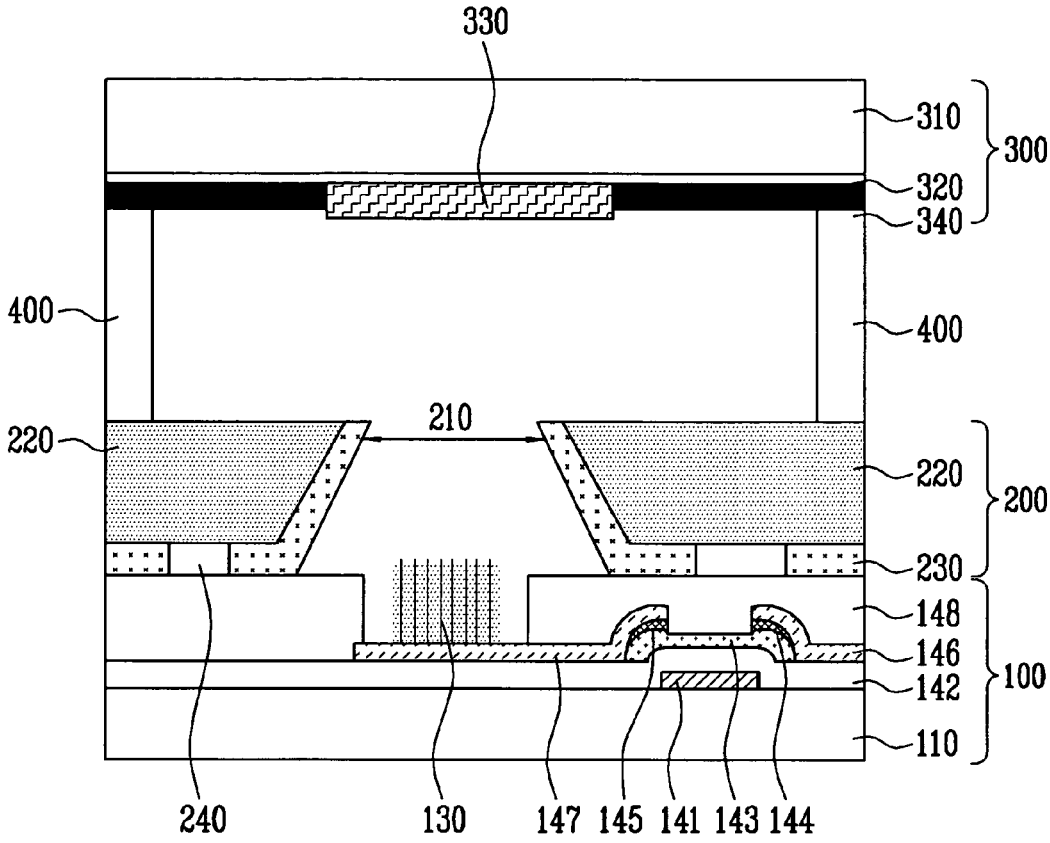
FIG. 6 is a cross-sectional view of a unit pixel taken along some portion of an FED in accordance with yet another embodiment of the present invention.

FIG. 6 is a cross-sectional view of a unit pixel taken along a portion of an FED in accordance with yet another embodiment of the present invention. A portion different from the above-described embodiment will be described for simplicity of description.

This embodiment differs from the FED of FIG. 4 in that a dielectric layer 230 of a gate portion 200 is formed only on a portion of a metal mesh 220. A region where the dielectric layer 230 is not formed (denoted by 240 in FIG. 6) may be left empty. Such a structure may prevent the dielectric layer 230 from being damaged due to a difference of thermal expansion coefficients between the metal mesh 220 and the dielectric layer 230.

Figure 7:
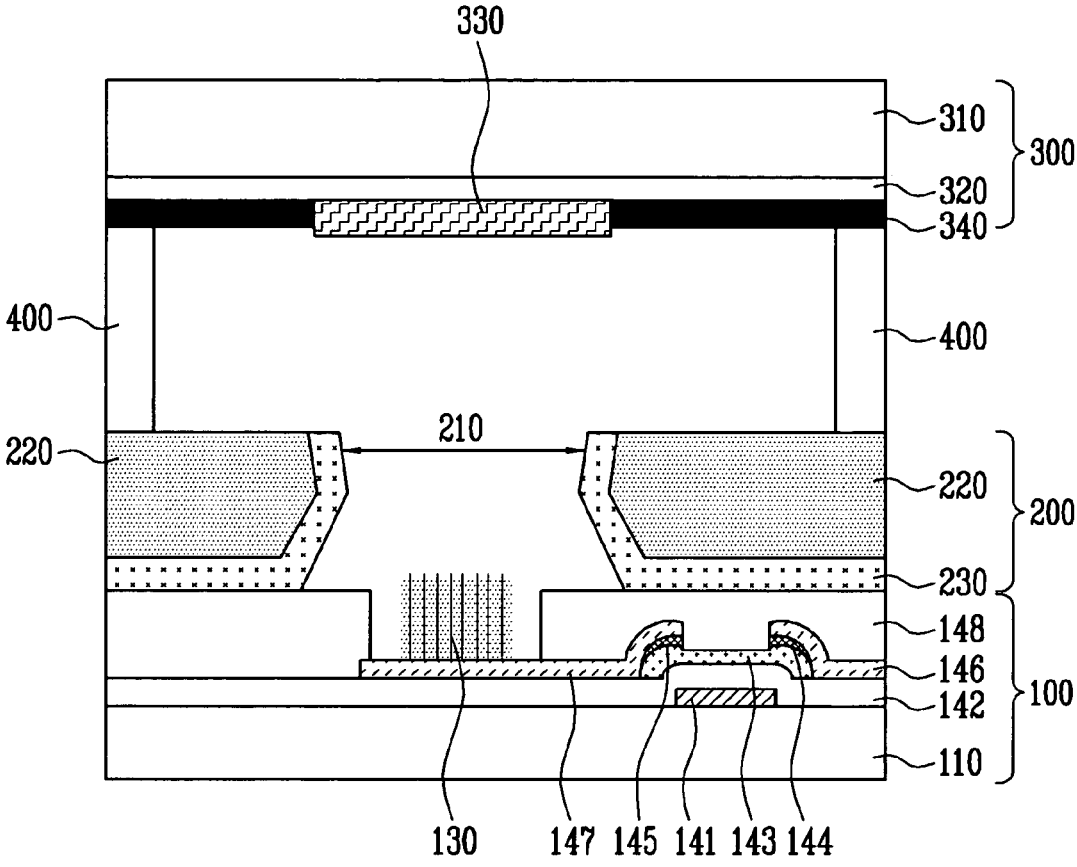
FIG. 7 is a cross-sectional view of a unit pixel taken along some portion of an FED in accordance with still another embodiment of the present invention.

FIG. 7 is a cross-sectional view of a unit pixel taken along some portion of an FED in accordance with still another embodiment of the present invention. A portion different from the above-described embodiment will be described for simplicity of description.

This embodiment differs from the FED of FIG. 4 in a shape of a metal mesh 220 of a gate portion 220. According to the present embodiment, an inner wall of the metal mesh 220 does not have a single inclined angle but has at least two inclined angles. Preferably, the inner wall of the metal mesh 220 may be formed to have a protrusion. By means of this structure, electrons emitted from the field emitter 130 may be more effectively focused on a phosphor 330 of an anode portion 300 facing the field emitter.

Figure 8:
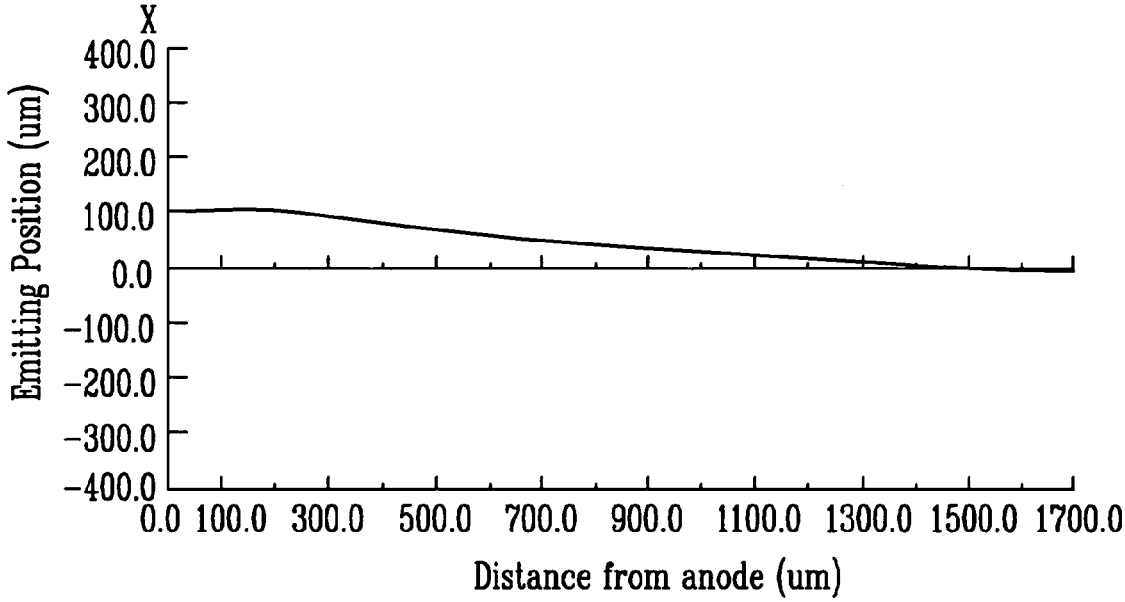
FIG. 8 is a graph showing simulation result of a trajectory of an electron beam in accordance with the present invention.

Next, a simulation result of electron beam trajectories according to an embodiment of the present invention will be described. FIG. 8 is a graph showing simulation result of a trajectory of an electron beam in accordance with an example of the present invention.

Detailed conditions of the simulation are as follows. Field emission was obtained from a gate portion having a dielectric layer with 20 μm in thickness and a metal mesh with 200 μm in thickness, and the electric field applied to the metal mesh for the field emission was 5V/μm, and the electric field applied to the anode electrode for anode acceleration was 5V/μm. FIG. 8 is a graph illustrating a simulation result of the electron beam trajectory according to a distance from the anode. According to this result, the electron beam locus has a variance within 15 μm at an anode far from the anode by 1.7 mm, which shows that the effect of focusing the electron beams is good.

As mentioned above, the voltage for driving row and column signal lines of the FED may be significantly reduced, so that a low voltage drive circuit with low costs may be employed instead of the high voltage drive circuit required for driving row and column signal lines of the conventional diode type FED.

Meanwhile, the electric field necessary for the field emission may be applied via the metal mesh of the gate portion, so that an interval between the anode portion and the cathode portion may be freely adjusted, which in turn allows a high voltage to be applied to the anode electrode, thereby remarkably enhancing the brightness of the FED.

In addition, the voltage applied to the metal mesh of the gate portion suppresses electron emission of the field emitter due to the anode voltage, and a uniform potential is formed as a whole between the anode portion and the gate portion, so that local arcing may be prevented and the lifetime of the FED may be significantly enhanced.

In addition, the gate portion may be independently manufactured from the cathode portion and then assembled together so that its manufacturing process is very simple, and breakdown phenomenon of the gate insulating layer of the field emitter may be essentially prevented so that manufacturing productivity and yield of the FED may be significantly enhanced.

Meanwhile, the penetrating hole of the metal mesh having the inclined inner wall acts to allow electrons emitted from the field emitter to be focused on the phosphor of the anode, which in turn allows the FED having a high resolution to be manufactured without requiring additional focusing grids.

Although exemplary embodiments of the present invention have been described with reference to the attached drawings, the present invention is not limited to these embodiments, and it should be appreciated to those skilled in the art that a variety of modifications and changes can be made without departing from the spirit and scope of the present invention.

What is claimed is:

1. A field emission display (FED) comprising:

a cathode portion including row signal lines and column signal lines in a stripe form allowing matrix addressing to be carried out on a substrate, and pixels defined by the row signal lines and the column signal lines, each pixel having a field emitter and a control device which comprises two terminals connected to at least the row and column signal lines and one terminal connected to an electrode on which the field emitter is disposed, wherein the control device controls the field emitter;

an anode portion having an anode electrode, and a phosphor connected to the anode electrode; and a gate portion having a metal mesh for receiving a voltage, the metal mesh having a plurality of penetrating holes, and a dielectric layer formed on at least one region of the metal mesh, wherein the gate portion is disposed between the cathode portion and the anode portion to allow the surface where the dielectric layer is formed to be faced to the cathode portion and to allow electrons emitted from the field emitter to collide with the phosphor via the penetrating holes thereof, and wherein the gate portion including the dielectric layer is separated from the electrode on which the field emitter is formed, wherein the penetrating hole in the metal mesh has at least one inclined inner wall such that the size of the penetrating hole in the metal mesh decreases as it extends towards the anode, such that electrons emitted from the field emitter are focused on the phosphor, wherein the dielectric layer is formed to cover at least the inclined inner wall of the penetrating hole in the metal mesh to prevent electrons from directly colliding with the metal mesh.

2. The FED as claimed in claim 1, wherein the anode portion, the cathode portion, and the gate portion are separately manufactured.

3. The FED as claimed in claim 1, wherein the dielectric layer is selectively formed on the inclined inner wall of the penetrating hole and on only a portion of a bottom surface of the metal mesh.

4. The FED as claimed in claim 1, wherein the inner wall of the metal mesh includes at least two inclined angles such that the inner wall of the penetrating hole in the metal mesh protrudes outward.

5. The FED as claimed in claim 1, wherein the metal mesh of the gate portion is a metal plate formed of one of aluminum, iron, copper, and nickel, or an alloy plate containing one of stainless steel, invar, and kovar.

6. The FED as claimed in claim 1, wherein the gate portion has a plurality of penetrating holes per one pixel.

7. The FED as claimed in claim 1, further comprising a spacer disposed between the anode portion and the gate portion, and an inter-insulating layer formed between the dielectric layer of the gate portion and the cathode portion.

8. The FED as claimed in claim 1, wherein the field emitter is formed of a thin or thick film of any one of diamond, diamond carbon, carbon nanotube, and carbon nanofiber.

9. The FED as claimed in claim 1, wherein the control device is a thin film transistor (TFT) or a metal-oxide-semiconductor field effect transistor (MOSFET).

10. The FED as claimed in claim 1, wherein a direct current (DC) voltage is applied to the metal mesh to induce electron emission from the field emitter of the cathode portion, electrons emitted are accelerated with a high energy by applying a DC voltage to the anode electrode of the anode portion, and scan and data signals are addressed to the control device disposed at each pixel of the cathode portion so that the control device of the field emitter controls electron emission of the field emitter to realize images, wherein the voltage is supplied to the metal mesh such that electron emission of the field emitter due to the anode voltage is suppressed.

11. The FED as claimed in claim 1, wherein gray scale representation of images of the FED is ensured by a pulse amplitude modulation and/or a pulse width (duration) modulation of a data signal voltage applied to the field emitter via the control device.

12. The FED as claimed in claim 1, wherein a voltage of the data signal applied to the field emitter is a pulse having a level of 0V to 50V.

13. The FED as claimed in claim 1, wherein the control device is a thin film transistor, and has a gate formed of metal on the cathode portion, a gate insulating layer formed on the cathode portion having the gate, an active layer formed of a semiconductor thin film on a portion of the gate insulating layer and the gate, source and drain formed at both ends of the active layer, and wherein an inter-insulating layer is formed over the control device, the inter-insulating film having a contact hole for allowing the source or drain to be in contact with the field emitter.

14. The FED as claimed in claim 13, wherein the active layer of the thin film transistor is formed of an amorphous silicon or polysilicon layer.

* * * * *